US005942007A

United States Patent [19]

Berndt et al.

[11] Patent Number: 5,942,007

[45] **Date of Patent: *Aug. 24, 1999**

[54] DRY CLEANING METHOD AND SOLVENT

[75] Inventors: Dieter R. Berndt, Incline Village, Nev.; John McLeod Griffiss, San Francisco, Calif.

[73] Assignee: GreenEarth Cleaning, LLP, LeeWood, Kans.

[ * ] Notice: This patent issued on a continued prosecution application filed under 37 CFR 1.53(d), and is subject to the twenty year patent term provisions of 35 U.S.C. 154(a)(2).

[21] Appl. No.: 09/115,352

[22] Filed: Jul. 14, 1998

Related U.S. Application Data

[63] Continuation-in-part of application No. 09/918,629, Aug. 22, 1997, Pat. No. 5,865,852.

[51] Int. Cl.[6] ..... D06L 1/02; D06L 1/04

[52] U.S. Cl. ..... 8/142; 8/137; 68/16; 68/24; 68/18 R; 134/19; 134/21; 134/32; 134/33; 134/34; 134/105; 134/184; 134/201; 510/285

[58] Field of Search ..... 8/137, 142; 68/16, 68/24, 18 R; 134/19, 21, 32, 33, 34, 105, 184, 201; 510/285

[56] References Cited

U.S. PATENT DOCUMENTS

| | | | |
|---|---|---|---|
| 3,124,494 | 3/1964 | Charreau | 427/377 |
| 4,501,682 | 2/1985 | Goodman et al. | 510/242 |
| 4,685,930 | 8/1987 | Kasprzak | 8/139.1 |
| 4,708,807 | 11/1987 | Kemerer | 510/287 |
| 4,961,753 | 10/1990 | Donkers et al. | 8/115.65 |
| 5,702,535 | 12/1997 | Gray et al. | 134/10 |
| 5,865,852 | 2/1999 | Berndt | 8/142 |

*Primary Examiner*—Alan Diamond
*Attorney, Agent, or Firm*—Hickman Stephens & Coleman, LLP

[57] ABSTRACT

A dry cleaning system and method, in which specially designed or modified machinery is used in conjunction with a specific solvent which is derived from an organic/inorganic hybrid (organo silicone). In this class of organo silicones is a group known as cyclic siloxanes. The cyclic siloxanes present the basis for material composition of the solvent chemistry which allows this dry cleaning system to be highly effective. The cyclic-siloxane-based solvent allows the system to result in an environmentally friendly process which is, also, more effective in cleaning fabrics and the like than any known prior system. The siloxane composition is employed in a dry cleaning machine to carry out the method of the invention. In a preferred embodiment, the method comprises the steps of loading articles into a cleaning basket; agitating the articles and the siloxane composition in which they are immersed; removing most of the siloxane composition; centrifuging the articles; subjecting the articles to a partial vacuum pressure and elevated temperature; and removing the articles from the basket after cooling the articles and returning the pressure to ambient.

24 Claims, 1 Drawing Sheet

DRY CLEANING METHOD AND SOLVENT

CROSS-REFERENCE TO RELATED APPLICATIONS

This application is a continuation-in-part of U.S. patent application Ser. No. 08/918,629 filed Aug. 22, 1997, now issued Pat. No. 5,865,852.

BACKGROUND OF THE INVENTION

1. Field of the Invention

This invention is in the general field of dry cleaning of clothing, textiles, fabrics and the like. The invention is more particularly directed to a method and apparatus for dry cleaning fabrics using a solvent not heretofore used in dry cleaning machines. The invention is more particularly directed to a dry cleaning apparatus wherein a silicon-based solvent is utilized which has a desirable flash point rating (over 140 degrees Fahrenheit) and fabric-safe qualities (non-dye pulling and non-shrinkage) together with superior solvency for fatty acids, grease and oils in a specially designed dry cleaning process.

2. Prior Art

Dry cleaning is a major industry throughout the world. In the United States alone, there are more than forty thousand dry cleaners (many of these have multiple locations).

The dry cleaning industry is an essential industry in the present economy. Many articles of clothing (and other items) must be dry cleaned in order to remain clean (the removal of body fats and oils), and presentable (do not shrink or discolor clothing).

The most widely used dry cleaning solvent until now has been Perc. There are numerous disadvantages to Perc including its toxicity and odor. The machinery widely used, until now, has been manufactured specifically for use with Perc. This has been another limiting factor in the industry.

Another problem in this field is that different fabrics require different handling in the presently used systems in order to prevent damage to the fabrics during the dry cleaning process.

The prior art in dry cleaning includes the use of various solvents with appropriate machinery to accomplish the cleaning. In the most recent past, the solvent most widely used has been perchloroethylene (herein generally referred to as "Perc"). Perc has the advantage of being an excellent cleaning solvent, but the disadvantage of being a major health and environmental hazard (i.e., it has been linked to numerous forms of cancer and it is very destructive to ground water and aquatic life). In some areas Perc is no longer allowed to be used. Additionally, in the past other solvents such as petroleum-based solvents and glycol ethers and esters have been tried and used. These various solvents have been used with mixed cleaning results and problematic fabric/textile compatibility as compared to the results obtained with Perc.

The present invention is distinct from the prior art that it relies upon a non-Perc solvent with superior characteristics as described below, and used in a method involving dry cleaning machinery which has been specially designed for the solvent.

The only use of a cyclic siloxane composition for cleaning purposes is disclosed in U.S. Pat. No. 4,685,930 to Kasprzak. However, the disclosure therein is for spot cleaning applications only. There is no disclosure of immersing articles into the cyclic siloxane nor is there any suggestion of using the cyclic siloxane in a dry cleaning machine.

Moreover, there is no suggestion of subjecting such articles immersed in cyclic siloxane to agitation, spinning, partial vacuum and heating in a continuous process to dry clean articles in a bulk process for removing fats, oils, grease and other soils from a large number of entire clothing articles.

SUMMARY OF THE INVENTION

The present invention comprises a novel dry cleaning system and method, in which specially designed or modified machinery is used in conjunction with a specific solvent which is derived from an organic/inorganic hybrid (organo silicone). In this class of organo silicones is a group known as cyclic siloxanes. The cyclic siloxanes present the basis for material composition of the solvent chemistry which allows this dry cleaning system to be highly effective. The cyclic-siloxane-based solvent allows the system to result in an environmentally friendly process which is, also, more effective in cleaning fabrics and the like than any known prior system. The siloxane composition is employed in a dry cleaning machine to carry out the method of the invention. In a preferred embodiment, the method comprises the steps of loading articles into a cleaning basket; agitating the articles and the siloxane composition in which they are immersed; removing most of the siloxane composition; centrifuging the articles; subjecting the articles to a partial vacuum pressure and elevated temperature; and removing the articles from the basket after cooling the articles and returning the pressure to ambient.

OBJECTS OF THE INVENTION

It is therefore a principal object of this invention to provide a method of dry cleaning using environmentally friendly solvents and techniques.

It is another object of this invention to provide a dry cleaning method wherein the articles being cleaned are not harmed by the solvent.

It is another object of this invention to provide a dry cleaning solvent which does not deposit and or build up in clothing and is also hypoallergenic.

Another object of this invention is to provide a dry cleaning solvent which has unique flammability characteristics, wherein the flashpoint and fire point are separated by at least 10 degrees Fahrenheit whereby the solvent is self extinguishing between the flashpoint and the firepoint.

Yet another object of this invention is to provide a dry cleaning solvent which can be heated above room temperature (over 70 degrees Fahrenheit) without causing harm to fabrics which further improves and speeds up the cleaning process.

Still another object of this invention is to provide a dry cleaning solvent which has a surface tension less than 18 dynes/square centimeter to better penetrate fabric fibers to remove debris to make it easier to remove the solvent from the fabric.

The foregoing and other objects and advantages of this invention will become apparent to those skilled in the art based upon the following description of a preferred embodiment.

BRIEF DESCRIPTION OF THE DRAWING

The aforementioned objects and advantages of the present invention, as well as additional objects and advantages thereof, will be more fully understood hereinafter as a result of a detailed description of a preferred embodiment when taken in conjunction with the following drawing in which.

DETAILED DESCRIPTION OF A PREFERRED EMBODIMENT

Figure 1:
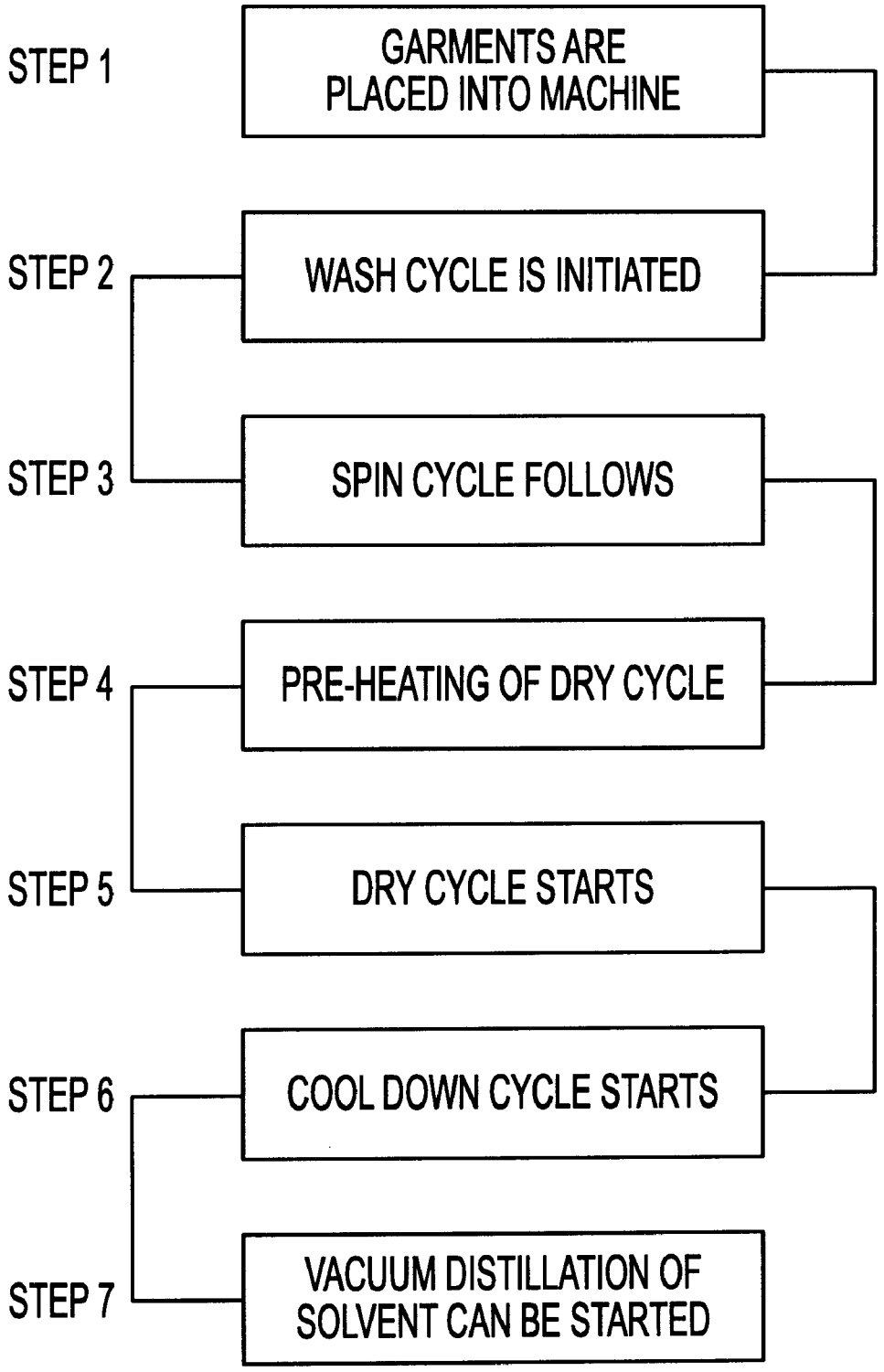
FIG. 1 is a block diagram of the steps of the process showing one embodiment of the present invention.

The present method of dry cleaning is unique, particularly with the use of a commonly known fluid class of cyclic siloxanes used for cosmetics and topical pharmaceuticals. These cyclic siloxanes are more particularly known as octamethyl-cyclotetrasiloxane (tetramer) and decamethyl-cyclopentasiloxane (pentamer). These fluids have never been disclosed as a dry cleaning solvent alternative for use in a dry cleaning machine. Combinations of the above tetramer and pentamer are by themselves not completely suitable for dry cleaning in their pure form. They are modified in the dry cleaning method of the preferred embodiment. The modification is in the form of adding soil suspending additives to prevent redeposition of dirt during the wash and rinse cycle, detergents for water-base stains, and disinfectants for the disinfection of bacteria and other forms of microorganisms which are present in all clothing.

The following steps more specifically describe the dry cleaning method of the preferred embodiment:

At step 1 garments or other items to be dry cleaned are placed in a vertical combination washer dryer with a horizontally rotating agitating cleaning basket (known to those skilled in the art). The barrel of the basket will have numerous holes or perforations, preferably each hole will be ⅛ to ⅜ inches in diameter.

At step 2 the wash cycle is initiated with the solvent consisting of a combination of the tetramer and pentamer cyclic siloxane. The preferred combination is 80% tetramer and 20% pentamer by weight. The additives which modify the above mixture may be added separately just before the washing cycle and need not be part of the solvent composition. The use of these additives, namely detergents and suspending agents, allows the solvent to perform a total garment cleaning process. The solvent is pumped from a holding tank into the cleaning basket. The items being cleaned are agitated, such that the mechanical rubbing of the clothes and the infiltrating solvent dissolves and loosens dirt, debris and body fats from the fabric fibers, said agitation lasting from 3 to 10 minutes or more. The solvent is then pumped out of the basket back into the holding tank through a charcoal and/or clay filter system in order to remove the impurities which may have entered the solvent during the washing cycle.

At step 3 the items having been cleaned are spin dried, preferably for about three to five minutes somewhere between 350 to 1000 rpm (revolutions per minute); preferably between 450 to 750 rpm. This operation leaves no more than 3% solvent residue in the items being cleaned. The higher the rpm, the faster the solvent is removed by the centrifugal force of the spinning basket. The very low surface tension of the solvent maximizes the efficacy of solvent removal via this centrifugal spinning process.

At step 4 the garments are tumbled in the basket and heated to a temperature between 120 to 140 degrees Fahrenheit. This is accomplished by passing pressurized steam through a coil which heats up the air inside the basket through the use of a circulating fan. While this is happening, a partial vacuum is created inside the machine at negative pressure between 500 and 600 millimeters of mercury (where atmospheric pressure is 760 mm.). During this heating cycle, the solvent is vaporized and carried by circulating air to a refrigerated condensing coil which condenses the solvent from a vapor to a liquid collected out of the main air stream. In time, typically 15 to 20 minutes, all the solvent is removed from the garments.

At step 5 the heating cycle is stopped and the cooling cycle begins. The temperature is reduced from 140 degrees Fahrenheit to below 100 degrees Fahrenheit. This is accomplished by eliminating the vacuum and circulating the air through the refrigerated coils until the process is complete.

The cleaning process is complete when the garments are removed from the machine at near body temperature or below to reduce secondary wrinkling. Removing the garments at a high temperature would cause wrinkling.

Having thus disclosed a preferred embodiment of the method and apparatus of the present invention, it being understood that the description is only exemplary and not necessarily limiting of the scope of the invention, what is claimed is:

1. A method of dry cleaning articles comprising the steps of:

immersing said articles to be dry cleaned in a dry cleaning fluid including a cyclic siloxane composition;

agitating said articles in said cyclic siloxane composition;

removing said cyclic siloxane composition from said articles by centrifugal action and by circulating air about said articles;

maintaining the temperature of said circulating air between 120 to 140 degrees Fahrenheit during the removal of said cyclic siloxane composition from said articles; and then preventing said articles from wrinkling by cooling said articles below 100 degrees Fahrenheit.

2. The method recited in claim 1, wherein said articles being dry cleaned, after having been agitated, but before being centrifuged and heated, are subjected to a vacuum by reducing the pressure to lower the flashpoint of said cyclic siloxane composition.

3. The method recited in claim 1, wherein said cyclic siloxane composition comprises pentamer and tetramer cyclic siloxane as a solvent.

4. The method recited in claim 3, wherein said tetramer cyclic siloxane is 80% by weight and said pentamer cyclic siloxane is 20% by weight, based on the weight of the solvent.

5. The method recited in claim 1, wherein said cyclic siloxane composition comprises a mixture of octamethyl-cyclotetrasiloxane and decamethyl-cyclopentasiloxane.

6. The method recited in claim 1, wherein said cyclic siloxane composition comprises a mixture of at least two forms of cyclic siloxanes.

7. The method recited in claim 1, further comprising the step of:

containing said articles in a cleaning basket.

8. The method recited in claim 1, wherein said cleaning basket includes a plurality of holes having diameters between ⅛ to ⅜ inches.

9. The method recited in claim 1, further comprising the step of:

subjecting said articles to a partial vacuum.

10. The method recited in claim 1, wherein said centrifugal action includes spinning said articles at a rate between 350 RPM to 1000 RPM.

11. The method recited in claim 10, wherein said centrifugal action includes spinning said articles at a rate between 450 RPM to 750 RPM.

12. The method recited in claim 1, wherein said centrifugal action leaves no more than 3% of said cyclic siloxane composition in said articles.

13. The method recited in claim 1, wherein said articles in said cyclic siloxane composition are agitated for a time period between 3 and 10 minutes.

14. The method recited in claim 1, further comprising the step of:

filtering said cyclic siloxane composition for removing impurities that have entered said cyclic siloxane composition when said articles are agitated.

15. The method recited in claim 1, wherein said dry cleaning fluid further comprises a detergent, a disinfectant, suspending agents and brighteners.

16. The method recited in claim 1, wherein said articles are cooled by circulating said air through refrigerated coils.

17. A method of dry cleaning articles comprising the steps of:

immersing said articles to be dry cleaned in a dry cleaning fluid including a cyclic siloxane composition;

agitating said articles in said composition; and removing said composition from said articles by centrifugal action and heat;

wherein said articles being dry cleaned, after having been agitated, but before being centrifuged and heated, are subjected to a vacuum by reducing the pressure to lower the flashpoint of said composition.

18. The method recited in claim 17, wherein said composition comprises pentamer and tetramer cyclic siloxane as a solvent.

19. The method recited in claim 17, wherein said composition comprises a detergent, a disinfectant, suspending agents and brighteners.

20. A method of dry cleaning articles comprising the steps of:

placing said articles to be dry cleaned in a cleaning basket of a washer and dryer combination;

introducing a cyclic siloxane composition into said cleaning basket;

agitating said articles and said composition in said cleaning basket;

centrifuging said articles in said cleaning basket to remove said composition from said articles;

subjecting said articles in said cleaning basket to a partial vacuum;

heating said articles in said cleaning basket and under said partial vacuum;

cooling said articles; and removing said articles from said cleaning basket.

21. The method recited in claim 20; wherein said composition comprises a mixture of octamethyl-cyclotetrasiloxane and decamethyl-cyclopentasiloxane.

22. The method recited in claim 20, wherein said composition comprises a mixture of at least two forms of cyclic siloxanes.

23. The method recited in claim 20, wherein said composition further comprises a detergent.

24. The method recited in claim 20, wherein said composition further comprises at least one additive selected from the group consisting of detergents, disinfectants, suspending agents and brighteners.

* * * * *